US006150640A

United States Patent [19]

Huang

[11] Patent Number: 6,150,640

[45] Date of Patent: Nov. 21, 2000

[54] TEMPERATURE CONTROLLER FOR ELECTRIC COOKING APPLIANCES

[75] Inventor: Jin Yi Huang, Tainan Hsien, Taiwan

[73] Assignee: Ya Horng Electronic Co., Ltd., Tainan Hsien, Taiwan

[21] Appl. No.: 09/391,074

[22] Filed: Sep. 4, 1999

[51] Int. Cl.[7] ..... H05B 1/02

[52] U.S. Cl. ..... 219/507; 219/489; 219/493; 219/441; 307/141

[58] Field of Search ..... 219/489, 491, 219/493, 494, 507, 441, 442; 307/141, 140, 139

[56] References Cited

U.S. PATENT DOCUMENTS 4,210,824 7/1980 Marquis et al. ..... 307/141
4,315,139 2/1982 Onishi et al. ..... 219/441
4,616,209 10/1986 Mahon ..... 219/493
5,901,638 5/1999 Houel ..... 219/521

*Primary Examiner*—Mark Paschall
*Attorney, Agent, or Firm*—Pro-Techtor International Services

[57] ABSTRACT

A temperature controller for electric cooking appliances includes a activating button movably provided on an outer surface and a temperature controller fixed inside an electric cooking appliance. The temperature controller has a shaft and a gear fixed on an end of the shaft. The activating button has a connect member extending in the electric cooking appliance, and a base connected to the connect member, which has a rack formed under an upper wall to engage the gear. The rack has a width at least equal to the linear moving distance of the shaft. Then the activating button is moved rightward and leftward, letting the base with the rack move also so that the gear is rotated by the rack, with the shaft rotating to move forward or backward so as to set the wide range of temperature with many stages to be got for heating the electric cooking appliance.

3 Claims, 13 Drawing Sheets

TEMPERATURE CONTROLLER FOR ELECTRIC COOKING APPLIANCES

BACKGROUND OF THE INVENTION

This invention relates to a temperature controller for electric cooking appliances, particularly to one adjustable in a horizontal direction in a wide range of temperature with many stages of heat to be used for cooking.

Nowadays electric cooking appliances are mostly popular, such as frying pans, baking pans, ovens, etc. and provided with an electric heater as shown FIG. 1, which includes a heat transformer A1, a fix contact point A2, and a plate spring A3. The heat transformer A1 has a projection A4 on its end, and the contact point A2 is located between the heat transformer A1 and the plate spring A3. Further, a movable contact point A5 is provided on the plate spring 3 corresponding to the fix contact point A2 and the end of the plate spring A3 is near the projection A4 of the heat transformer A1. When this conventional heater is turned on, the fix contact point A2 and the movable contact point A5 contacts each other to let current through. As the temperature rises higher and higher in the heater, the heat transformer A1 is gradually disfigured to grow bigger and bigger until the heater reaches a certain temperature, then the projection A4 contacts the end of the plate spring A3 and pushes it forward, separating the movable contact point A5 from the contact point A2 to turn off the power. Next, as shown in FIG. 2, when the temperature of the cooking appliance falls down gradually and the heat transformer recovers its original shape, with the projection A4 retreating back to let the plate spring A3 move back to its original position, permitting the movable contact point A5 contact again the fix contact point A2 to turn on again the heater. This the most simple structure of the heater in the conventional electric cooking appliances.

Then a conventional temperature controller shown in FIG. 3 is additionally provided in conventional electric cooking appliances, having a turning button B1 for adjusting different temperature for cooking different foods. The turning button B1 includes a shaft B2 fixed with the button B1 located on an outer surface of an electric cooking appliance, and the shaft B2 has its end connected to one side of the plate spring A3. When the turning button B1 is rotated to force a male threaded section B21 of the shaft B2 rotate and move along a female threaded section of a fixing member B3 to the most front point, the plate spring A3 is moved by the shaft B2 with the largest push force so that the plate spring A3 transforms to force the movable contact point A5 automatically separate from the contact point A2. Then at this position, the temperature is set as OFF, with the power being in turned-off condition.

If the turning button B1 is turned to let the shaft B2 retreat, the shaft B2 is reduced in its push force, and the plate spring A3 also moves back to let the movable contact point A5 contact again the fix contact point A2 to turn on power to heat up. The temperature to be heated up depends on the push force of the plate spring A3. For example, if the shaft B2 is retreated only a little as shown in FIG. 4, the push force of the plate spring A3 is reduced only a little, so the projection A4 may contact the plate spring A3 to let the movable contact point A5 separate from the contact point A2 to turn off the power in case the heat transformer A1 disfigures only a little. Then the temperature is adjusted in the medium degree. If the shaft B2 is retreated to the farthest back as shown in FIG. 5, the shaft B2 does not push the plate spring A3, which then has no push force, and the power will not be turned off until the heat transformer A1 is heated up to disfigure to a the largest degree. Then the temperature is adjusted the highest, with the turning button B1 turned for more than 270 from the OFF point.

Some conventional electric cooking appliances use a temperature controller by means of linear movement of an activate rod instead of the turning button B1 just described, owing to their shape, as shown in FIG. 6. As the activating rod C cannot rotate the shaft B2, it uses a connect rod C1 for attaining the purpose. The activating rod C has a guide slot C2 in its inner end and the connect rod C1 has one end pivotally connected to the guide slot C2 and the other end fixed with the end of the shaft B2. Then the activating rod C is moved horizontally to rotate the shaft B2 forward or backward to set the temperature needed.

But the conventional temperature controller using this activating rod has the problem as follows. The limited length of the activating rod C restricts the swinging angle of the connect rod C1 within 180, so the rotating angle of the shaft B2 is limited within 180 so that the range of temperature adjustable is also limited, impossible to set a wide range of temperature as can as that using the turning button B1.

SUMMARY OF THE INVENTION

This invention has been devised to offer a temperature controller for electric cooking appliances, improving the conventional one using a activating rod to adjust temperature needed in a linear movement, widening the range of temperature usable and increasing stages of temperature changeable.

The feature of the invention is an activating button provided on an outer surface of an electric cooking appliance, and a temperature controller fixed in an inner side of the electric cooking appliance. The temperature controller includes a shaft rotatable to move forward and backward for a certain distance, a gear fixed on a front end of the shaft. The activating button connected to a base, which has a rack formed under an upper wall of the base. The rack engages with the gear, and when the activating button is moved rightward or leftward, the rack moves to rotate the gear, which then rotates the shaft synchronously so that the shaft may move forward or backward, adjusting the distance between the outer end of the shaft and the plate spring, i.e. adjusting the temperature to be got for heating the electric cooking appliance.

BRIEF DESCRIPTION OF DRAWINGS

This invention will be better understood by referring to the accompanying drawings, wherein.

DETAILED DESCRIPTION OF THE PREFERRED EMBODIMENT

Figure 2:
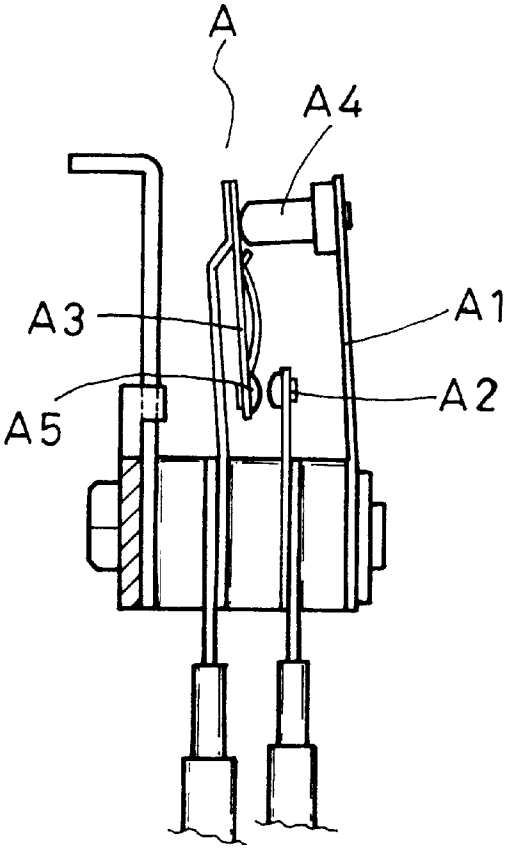
FIG. 2 (PRIOR ART)
FIG. 2 is a side view of the known conventional heater in FIG. 1, showing it being turned off.
Figure 1:
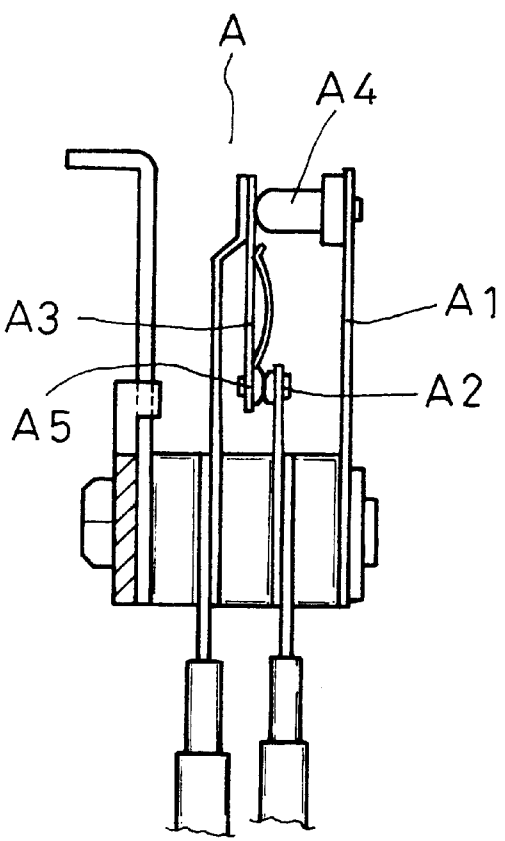
FIG. 1 (PRIOR ART)
FIG. 1 is a side view of a known conventional heater used in conventional electric cooking appliances.
Figure 3:
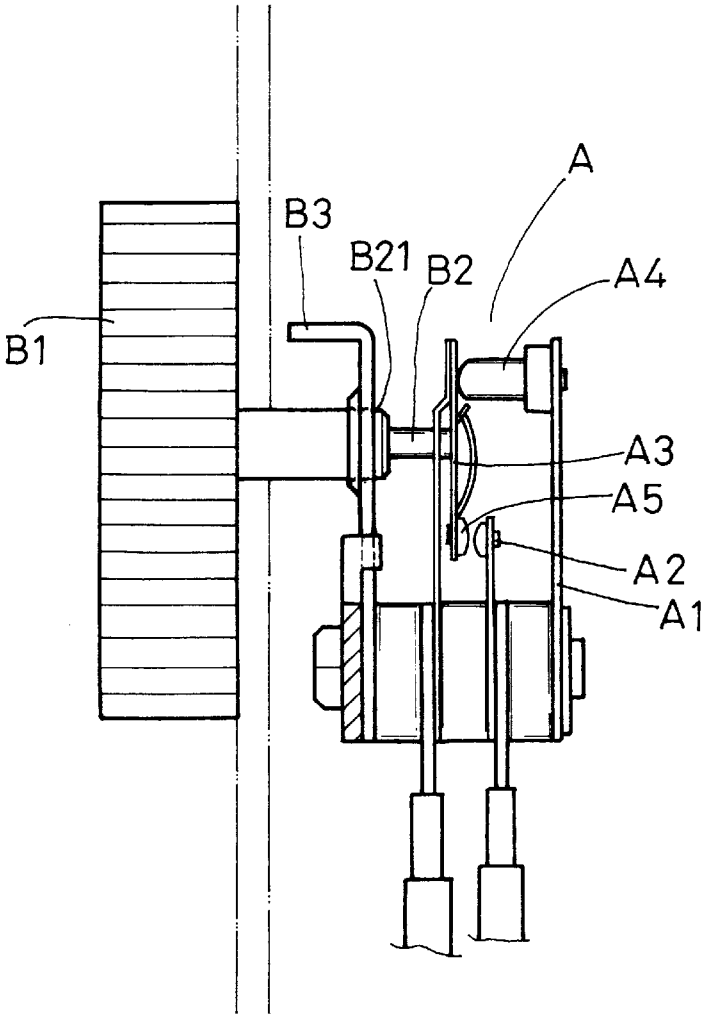
FIG. 3 (PRIOR ART)
FIG. 3 is a side view of a conventional temperature controller added to the known conventional heater used in conventional electric cooking appliances, showing it being turned off.
Figure 4:
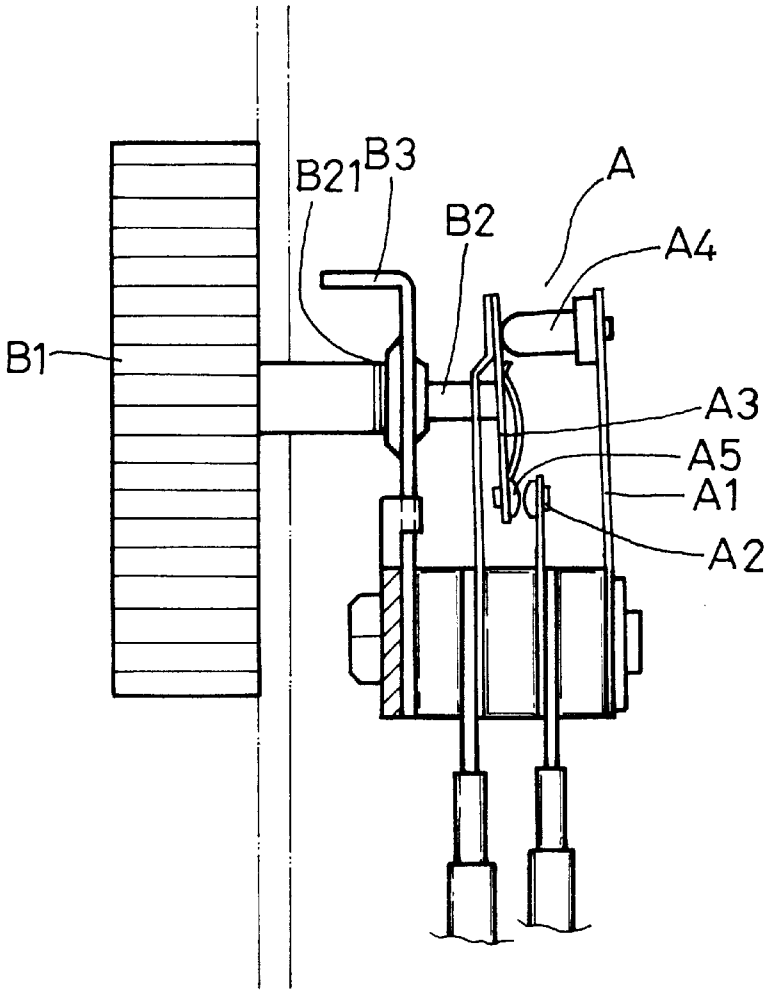
FIG. 4 (PRIOR ART)
FIG. 4 is a side view of the conventional temperature controller added to the known conventional heater used in a conventional electric cooking appliance, showing it adjusted to a medium temperature.
Figure 5:
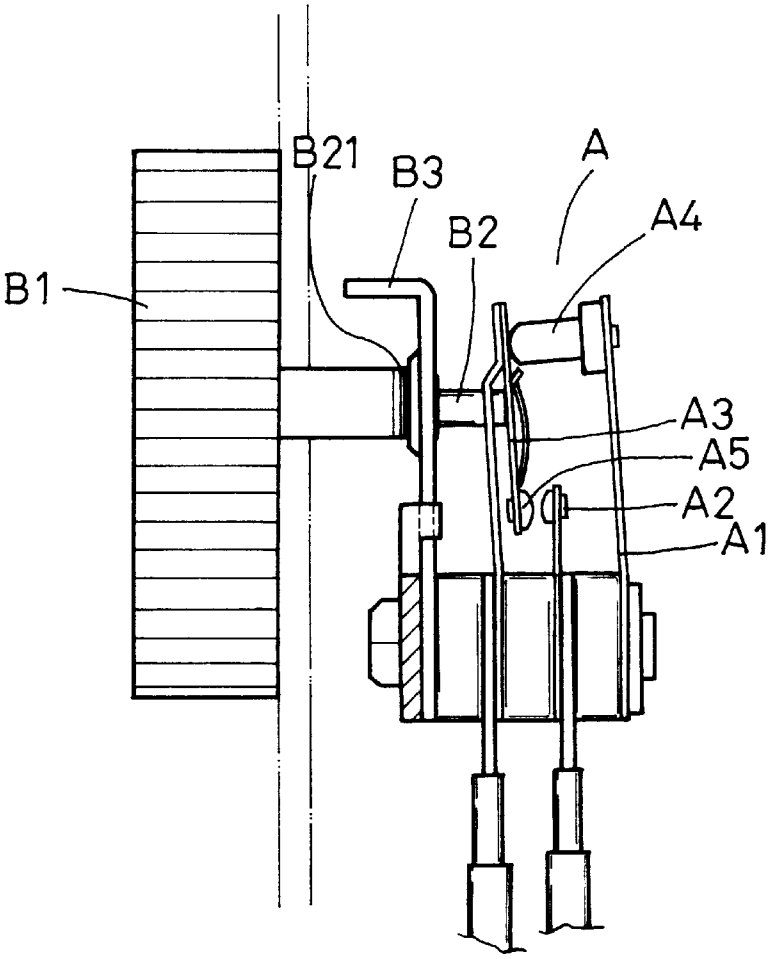
FIG. 5 (PRIOR ART)
FIG. 5 is a side view of the conventional temperature controller added to the known conventional heater used in a conventional electric cooking appliance, showing it adjusted to a high temperature.
Figure 6:
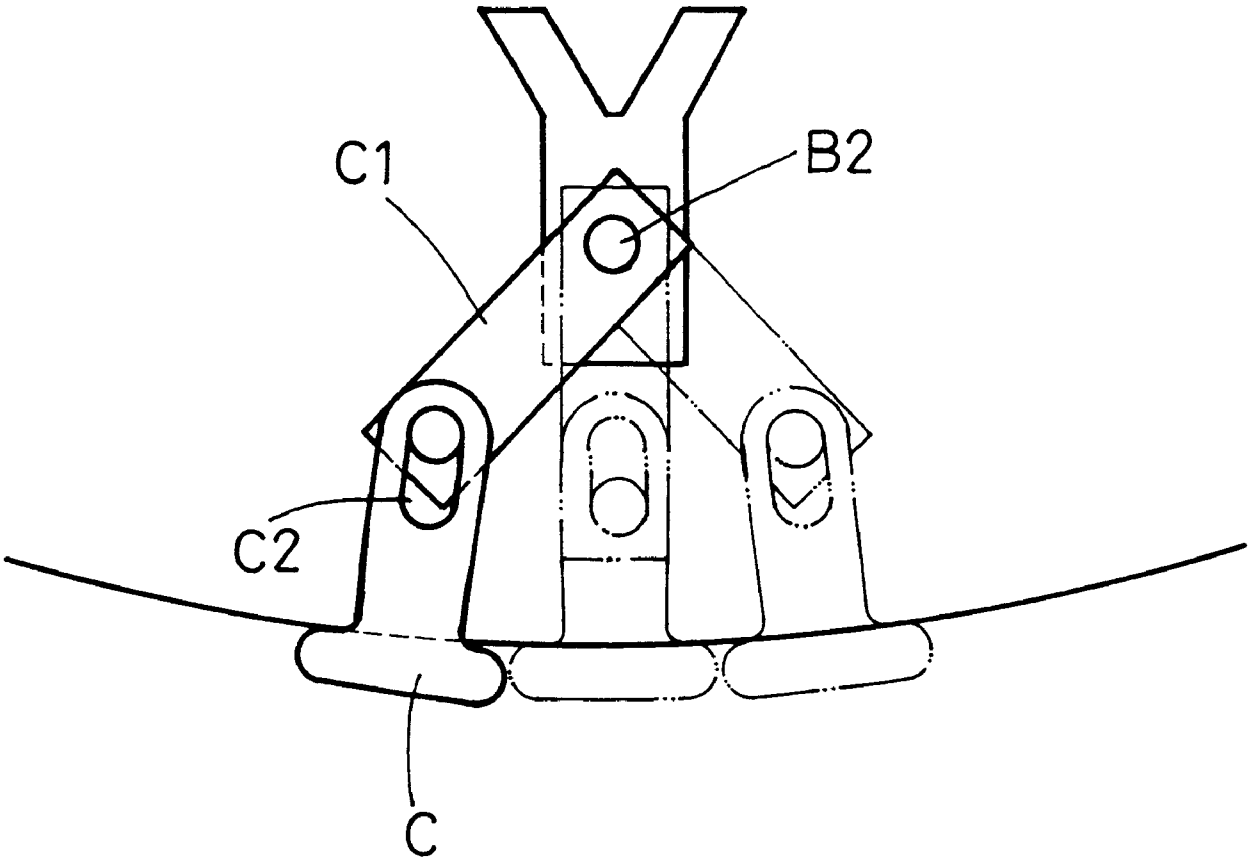
FIG. 6 (PRIOR ART)
FIG. 6 is an upper view of another conventional temperature controller for conventional electric cooking appliances, showing it being adjusted to set temperature needed.
Figure 7:
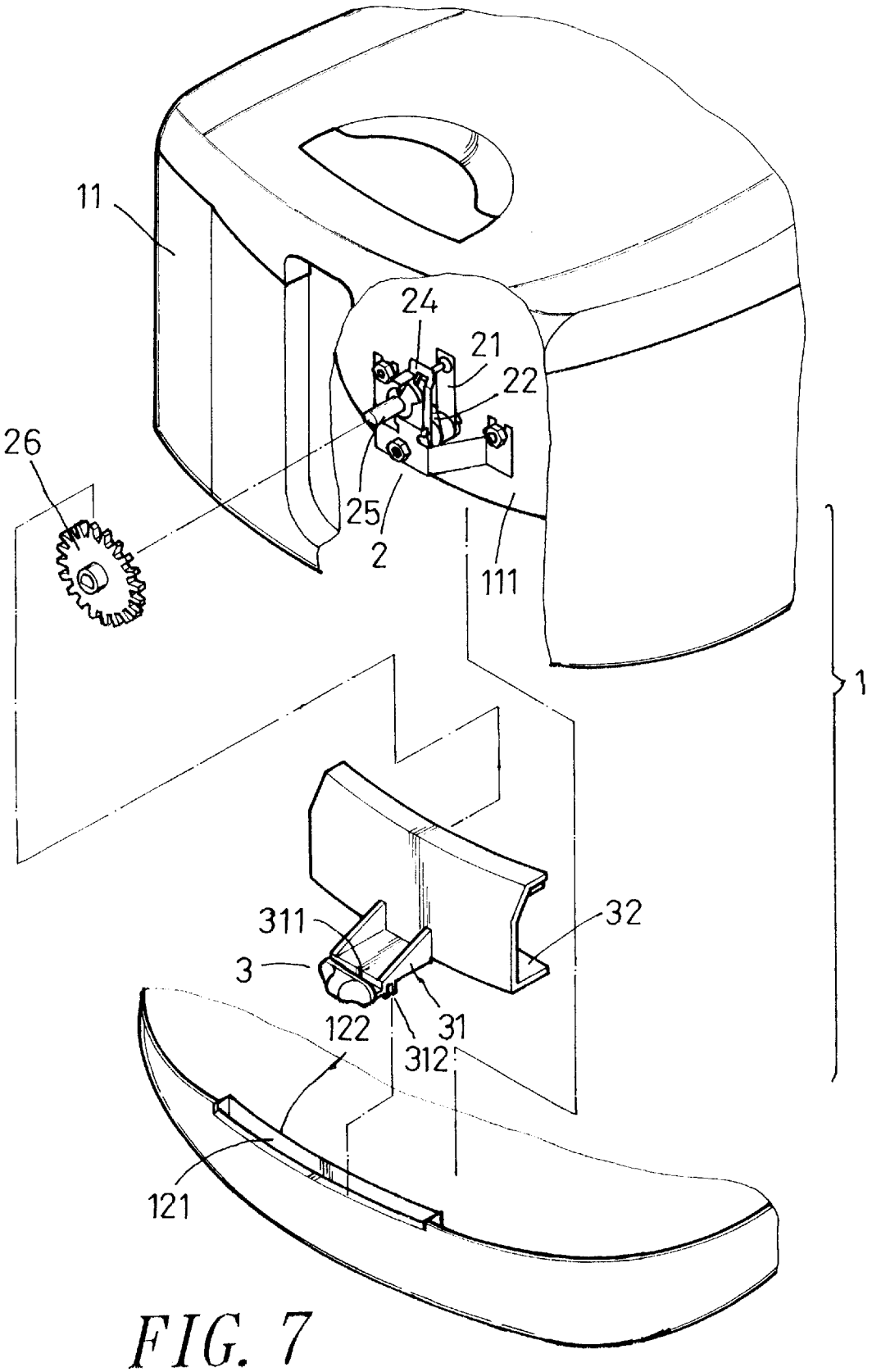
FIG. 7 is an exploded perspective view of a temperature controller for electric cooking appliances in the present invention.
Figure 8:
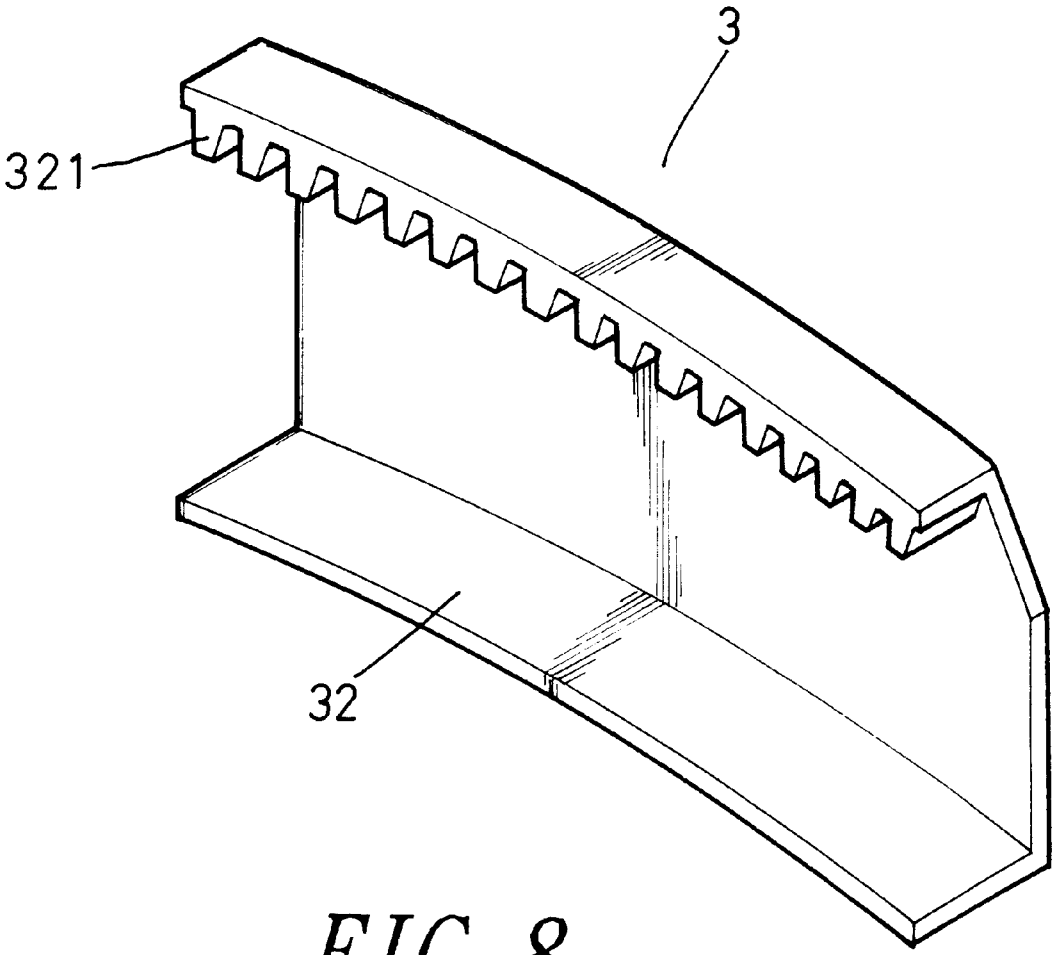
FIG. 8 is a magnified perspective view of an activating button in a temperature controller for electric cooking appliances in the present invention.
Figure 10:
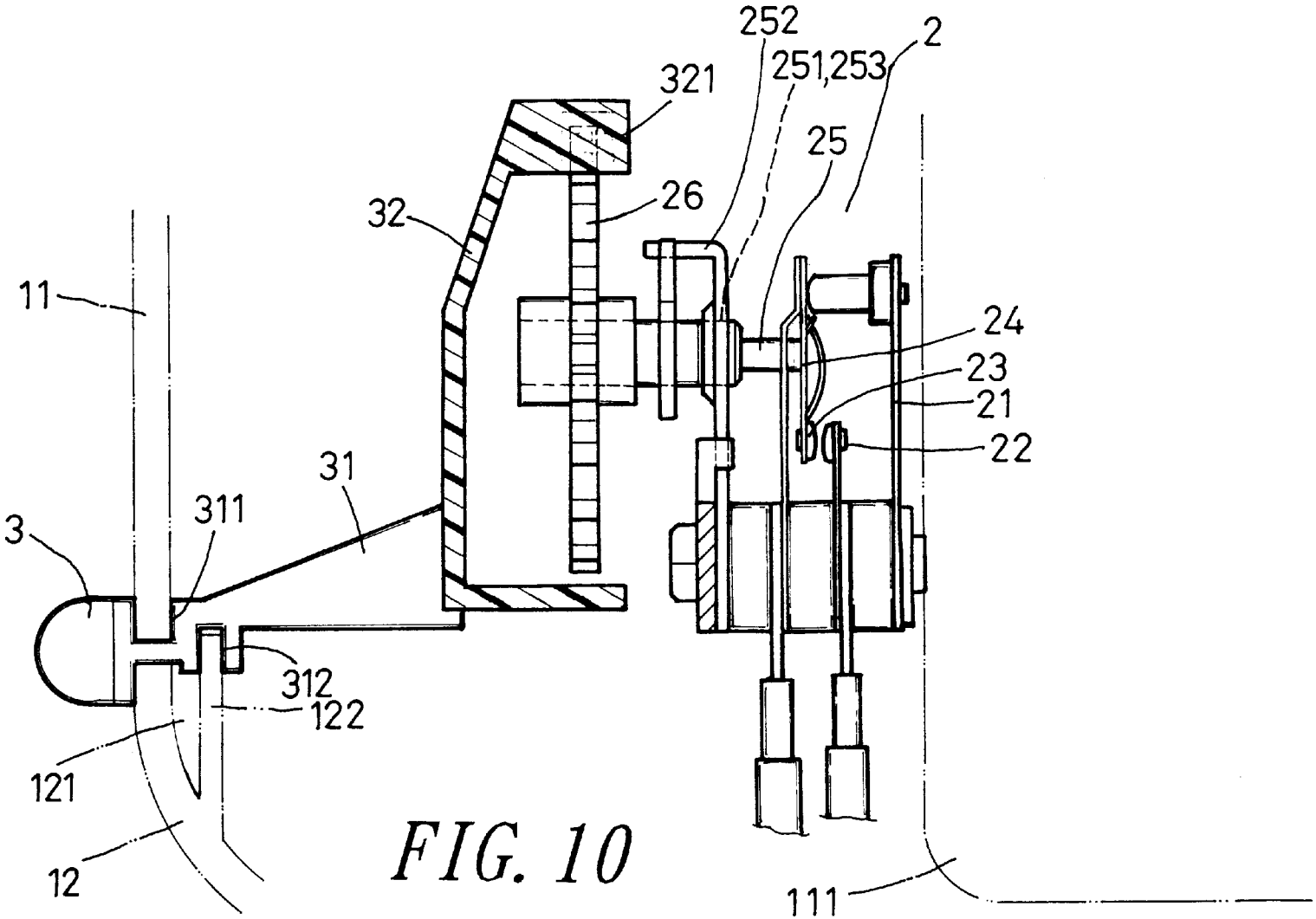
FIG. 10 is a cross-sectional view of line I—I in FIG. 8.

A preferred embodiment of a temperature controller 2 for electric cooking appliances in the present invention, as shown in FIGS. 7 and 8, is located inside an electric cooking appliance, including an activating button 3 provided on an outer surface of the appliance, which consists of an upper housing 11 and a lower housing 12, a cooking pan or an oven 111 contained in the upper housing 11, and a horizontal shallow long groove 121 formed in a front surface of the lower housing 12, an inserting vertical member 122 formed behind the shallow long groove 121 and having the same length as the groove 121 and of a little higher height than the groove 121 as shown in FIG. 10.

The temperature controller 2 includes a heat transformer 21, a fix contact point 22, a plate spring 24 provided with a movable contact point 23 on an end, a shaft 25 located at one side of the plate spring 24 and having its end facing the plate spring 24 and a male threaded section 251 formed in its intermediate section engaging with a female threaded hole 253 of a fix member 252 as shown in FIG. 10 and the outer end fixed with a a gear 26.

The activating button 3, as shown in FIGS. 8 and 10, has a connect member 31 extending in the appliance 1, a first groove 311 formed in an upper surface and a second groove 312 formed in a lower surface corresponding respectively to the shallow groove 121 and the insert vertical member 122 of the appliance 1. The connect member 31 is connected to a C-shape base 32 at the rear end, having a rack 321 formed in a lower surface of an upper wall. The rack 321 has at least a length enough for the gear 26 to rotate one round, and s width enough for the the gear 26 to engage the rack 321 without falling off the rack 321, regardless of back-and-forth movement of the gear 26 together with the shaft 25.

Figure 9:
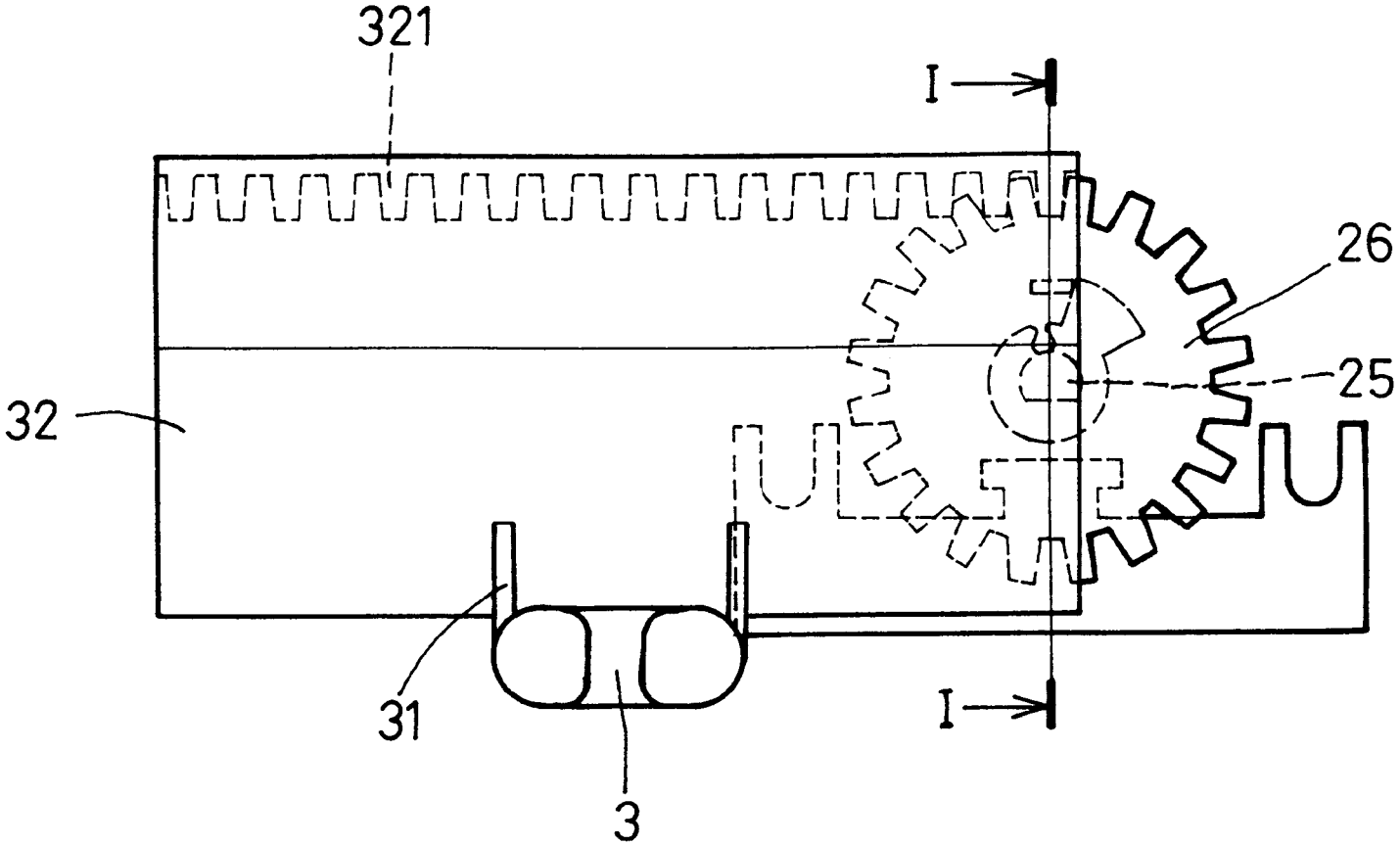
FIG. 9 is a cross-sectional view of the activating button in a temperature controller for electric cooking appliances, showing it being turned off.

In assembling, the temperature controller 2 is directly fixed above the cooking pan 111 inside the upper housing 11, with the shaft 25 moved to the most front point to let the movable contact point 23 separate from the fix contact point 22, i.e. turning off the power. At this position, the temperature is set at OFF, as shown in FIG. 10, and the activating button 3 has the rack 321 of the base 32 engaging the gear 26 fixed on the shaft 25, and the engaging point is at the left end of the rack 321 as shown in FIG. 9. The lower end of wall of the upper housing 11 fits in the first groove 311 of the connect member 31, and the lower housing 12 fixed with the bottom of the upper housing 11, with the insert vertical member 122 fitting in the second groove 312 of the connect member 31, permitting the activating button extending out of the electric cooking appliance 1. Thus the activating button 3 can be manually moved rightward and leftward within the shallow long groove 121.

Figure 11:
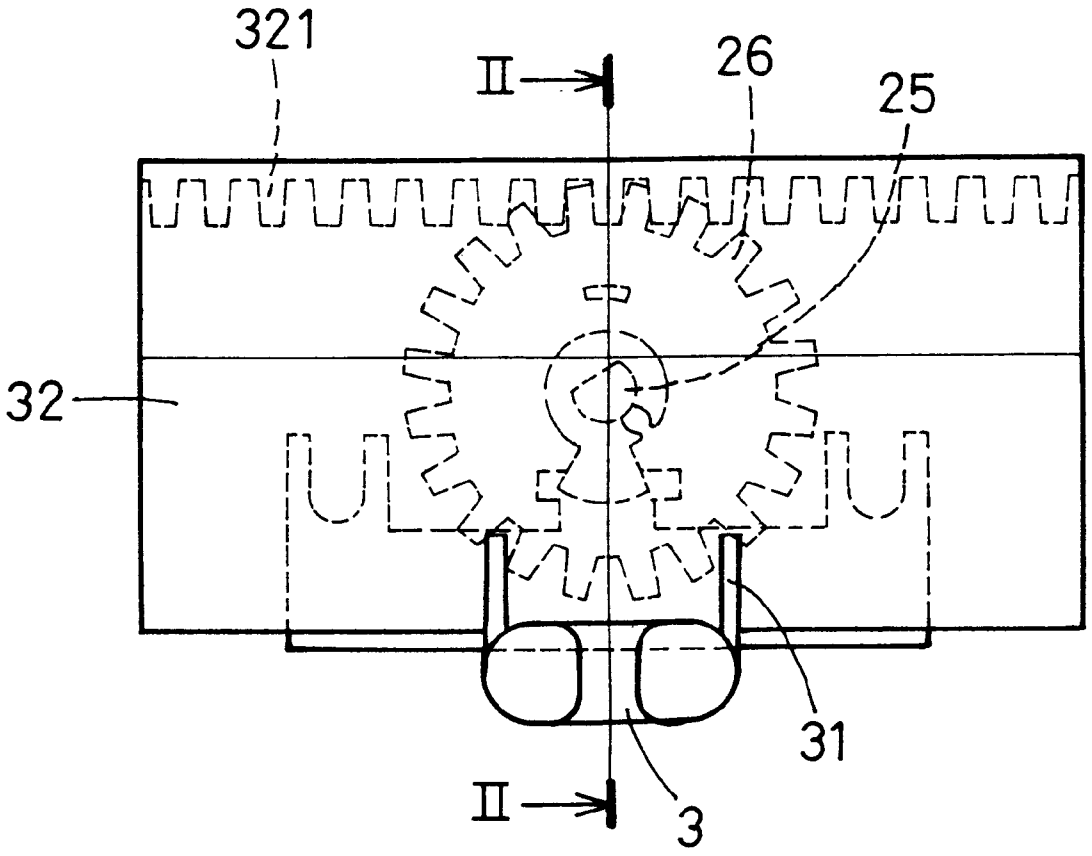
FIG. 11 is a side cross-sectional view of the temperature controller in the present invention, showing it adjusted to a medium temperature.
Figure 12:
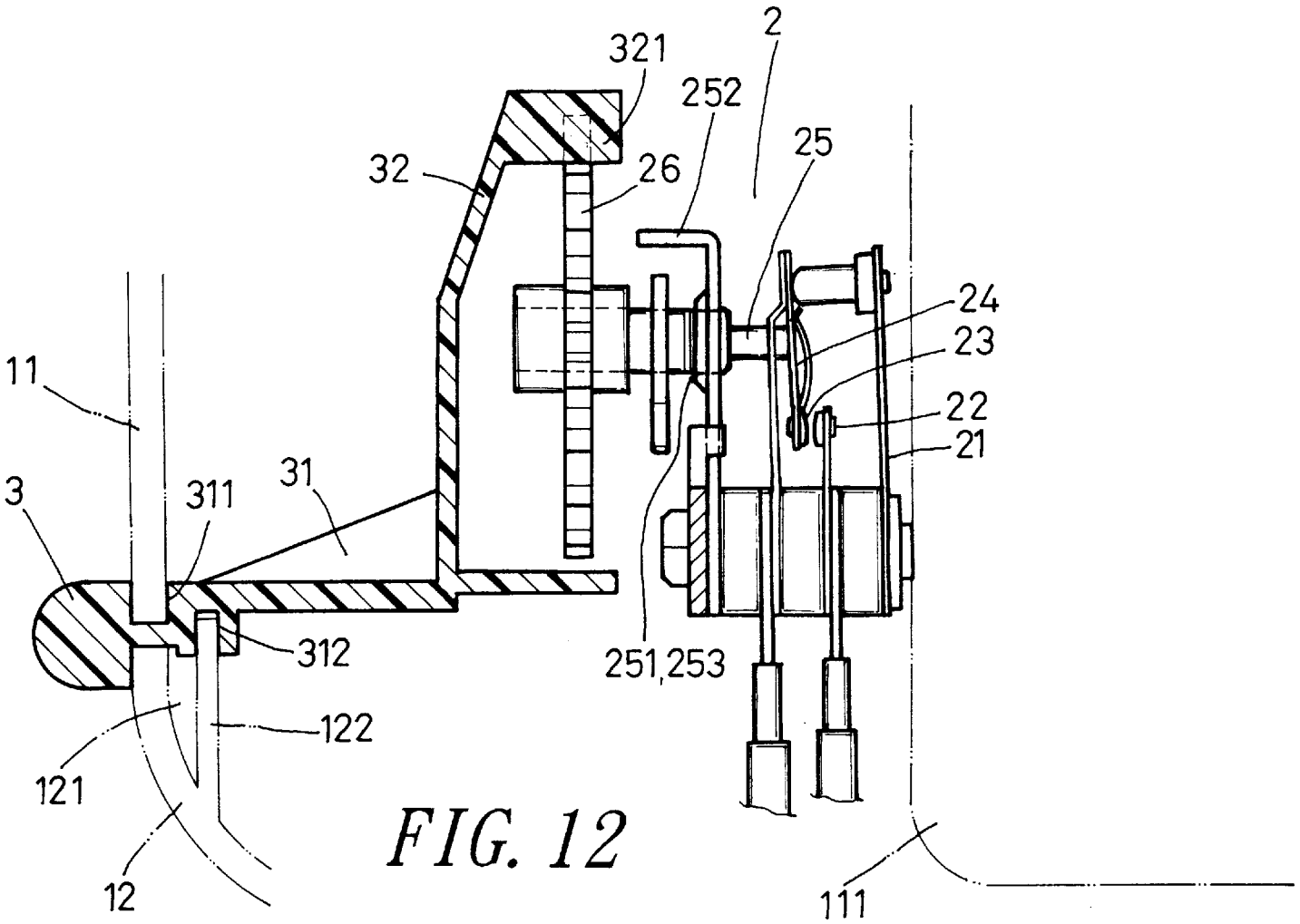
FIG. 12 is a cross-sectional view of line II—II in FIG. 8.
Figure 13:
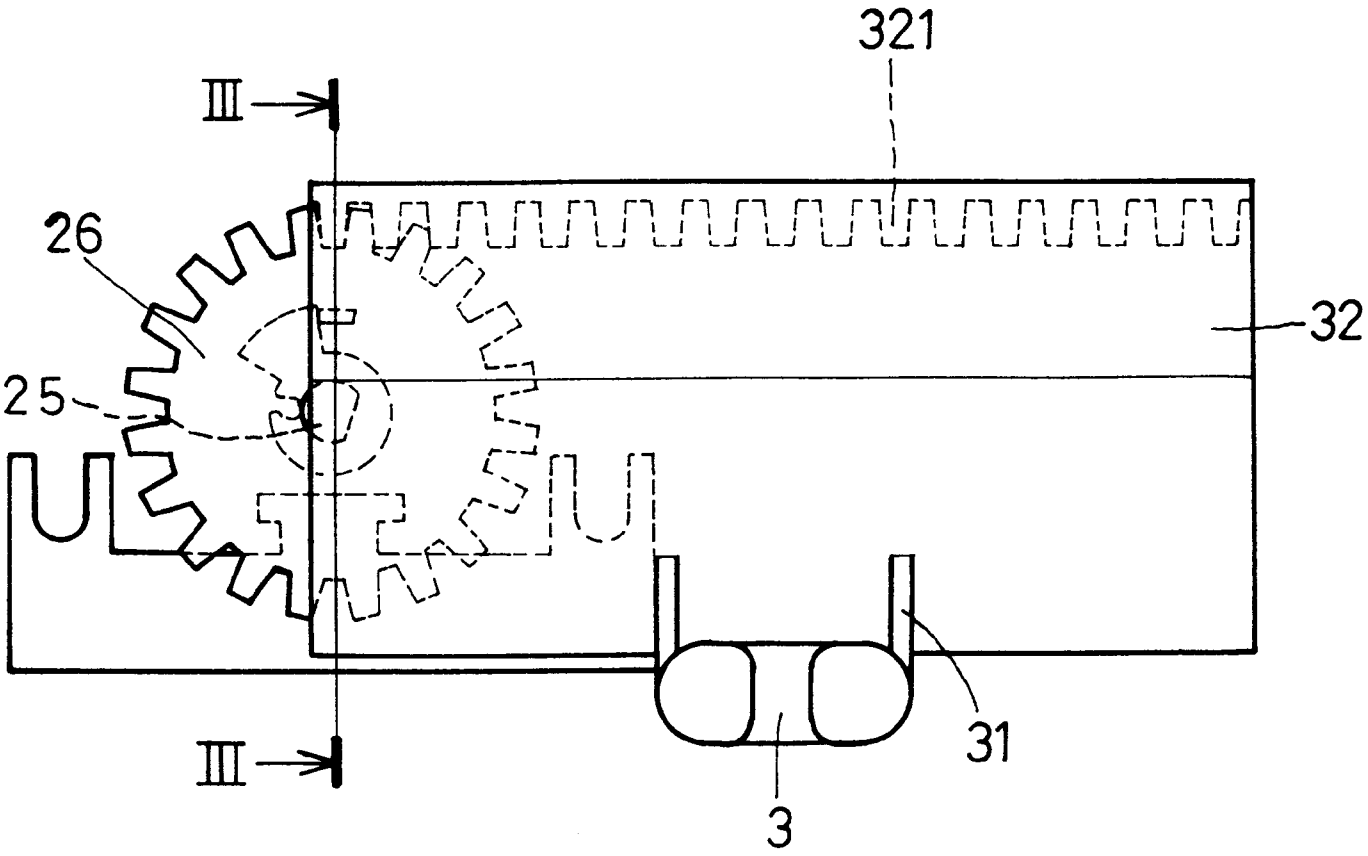
FIG. 13 is a side cross-sectional view of the temperature controller in the present invention, showing it adjusted to a high temperature; and, FIG. 14 is a cross-sectional view of line III—III in FIG. 12.
Figure 14:
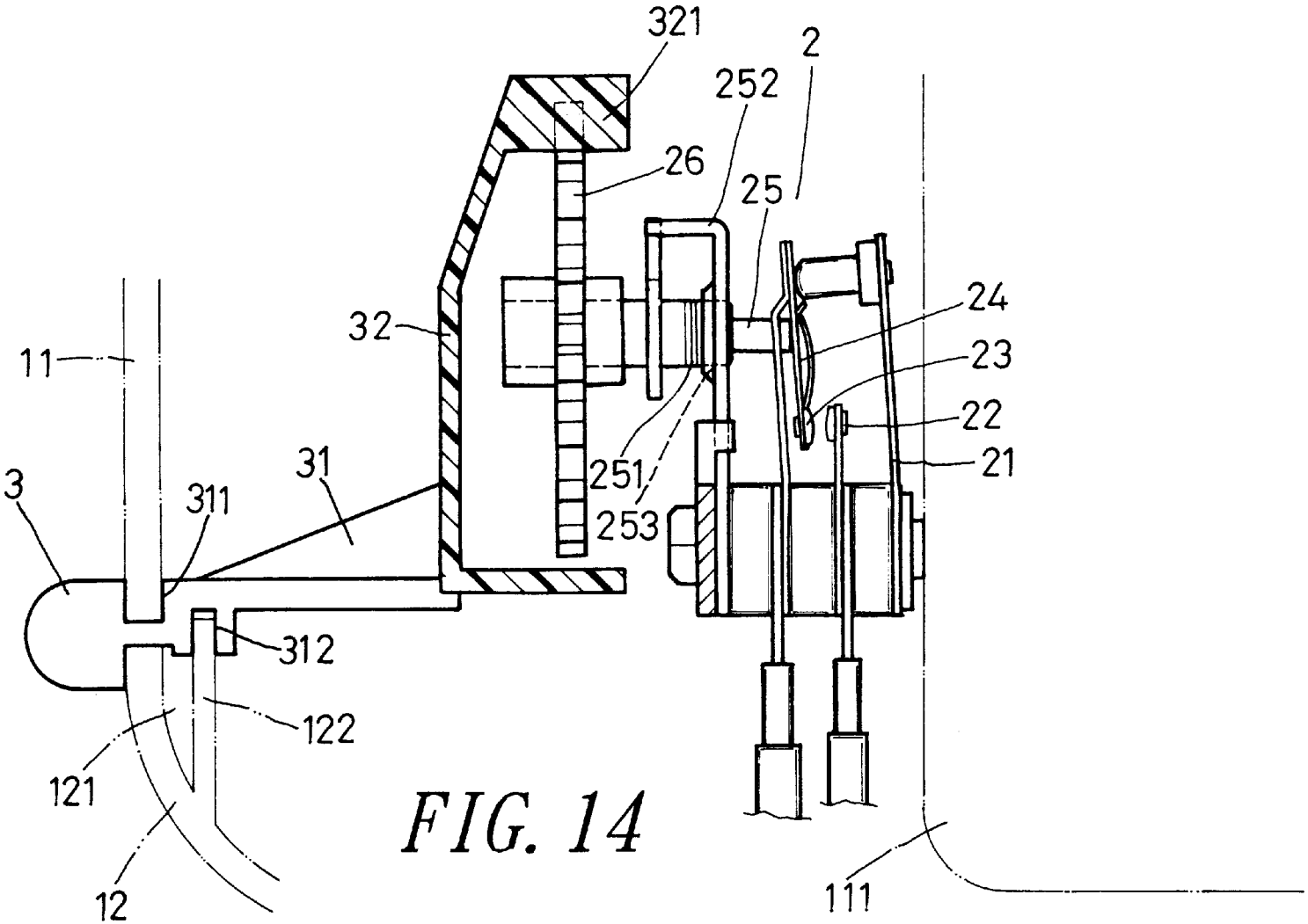

Next, FIGS. 11–14 show how the temperature controlller 2 in the invention is operated. When the activating button 3 is moved leftward or rightward in the shallow long groove 121, the rack 321 of the base 32 also moves synchronously and rotates the gear 26 so that the shaft 25 may be retreated from the plate spring 24 permitting the movable contact point 23 contact the fix contact point 22 to turn on the power. If the activating button 3 is moved to the middle section of the shallow long groove 121, the gear 26 is rotated half a round by the rack 321, the temperature to be got will be 150, a medium one, as shown in FIGS. 11 and 12. If the activating button 3 is moved to the left end of the groove 121, as shown in FIGS. 13 and 14, the gear 26 is rotated for a full round, permitting the shaft 25 retreat to the largest distance so that the heat transformer 21 may have the largest aperture to disfigure, i.e. the temperature to be got being the highest, with the shaft 25 rotating more than 270 from the OFF point.

In general, the activating button 3 moves in a straight line to permit the shaft 25 to rotate with many stages to change with stability a wide range of temperature to be got for heating an electric cooling appliance regardless of its linear movement.

While the preferred embodiment of the invention has been described above, it will be recognized and understood that various modifications may be made therein and the appended claims are intended to cover all such modifications which may fall within the spirit and scope of the invention.

I claim:

1. A temperature controller used for electric cooking appliances, said temperature controller being fixed on an outer surface of an inner cooking pan, said temperature controller comprising:

a movable activating button on an outer surface of an electric cooking appliance, a heat transformer, a fixed contact point, a plate spring having a movable contact point fixed on its free end, a shaft provided at one side of said plate spring, a temperature of said inner cooking pan depending on a distance between said plate spring and an outer end of said shaft, said outer end of said shaft is rotated to move an inner end of said shaft forward or backward through a range of motion, a direction of motion of said outer end of said shaft depending on a direction of rotation; and wherein, said temperature controller includes a gear fixed on said outer end of said shaft, and said activating button comprises a connect member extending into said electric cooking appliance and a base attached at an inner end of said connect member, said base includes a lengthwise rack, said lengthwise rack having a length at least equal to a linear distance of rotation of said gear required to move said second end of said shaft through said range of motion, said activating button being moved from side to side to cause said rack to move to rotate said gear and in turn said shaft to set a temperature desired for said electric cooking appliance.

2. The temperature controller for electric cooking appliances as claimed in claim 1 wherein:

said electric cooking appliance has an upper housing and a lower housing, said lower housing having a horizontal groove formed in an outer surface;

said connect member having a first groove formed in an upper surface and a second groove formed in a lower surface behind said activating button, said first groove receiving a lower end of a wall of said upper housing, said second groove receiving a vertical insertion member of said lower housing; such that said activating button moves back and forth relative to said upper housing and said lower housing of said cooking appliance.

3. The temperature controller for electric cooking appliances as claimed in claim 1 wherein:

said rack of said base is long enough to cause said gear to rotate for a full revolution when said activating button moves said gear from a first end of said rack to a second end of said rack.

* * * * *